United States Patent [19]

Sato et al.

[11] Patent Number: 4,853,582

[45] Date of Patent: Aug. 1, 1989

[54] SPARK PLUG FOR USE IN INTERNAL COMBUSTION ENGINE

[75] Inventors: Yasuyuki Sato, Kasugai; Masaki Sugata; Hiroyuki Murai, both of Anjo, all of Japan

[73] Assignee: Nippondenso Co., Ltd., Kariya, Japan

[21] Appl. No.: 177,651

[22] Filed: Apr. 5, 1988

[30] Foreign Application Priority Data

Apr. 6, 1987 [JP] Japan ..... 62-84087

[51] Int. Cl.[4] ..... H01T 13/39

[52] U.S. Cl. ..... 313/141; 313/144

[58] Field of Search ..... 313/141, 141.1, 144

[56] References Cited

U.S. PATENT DOCUMENTS

| | | | |
|---|---|---|---|
| 2,327,220 | 8/1943 | Ruddies | 313/141.1 |
| 4,540,910 | 9/1985 | Kondo et al. | 313/141 |
| 4,581,558 | 4/1986 | Takamura et al. | 313/141 |
| 4,670,684 | 6/1987 | Kagawa et al. | 313/141 |
| 4,699,600 | 10/1987 | Kondo . | |

FOREIGN PATENT DOCUMENTS

| | | |
|---|---|---|
| 57-180886 | 11/1982 | Japan . |
| 59-94391 | 5/1984 | Japan . |
| 59-169087 | 9/1984 | Japan . |
| 61-26748 | 2/1986 | Japan . |

*Primary Examiner*—Donald J. Yusko
*Assistant Examiner*—Sandra L. O'Shea
*Attorney, Agent, or Firm*—Cushman, Darby & Cushman

[57] ABSTRACT

A spark plug for use in internal combustion engines having a pair of electrodes between which electric spark discharge is effected. The spark plug has a spark discharge portion bonded by, for example, resistance welding to at least one of the electrodes and made of a base metal containing at least 90 wt % of chromium (Cr). A stress-relieving portion having a thermal expansion coefficient intermediate in value between those of the electrode and the spark discharge portion may be formed between the electrode and the spark discharge portion.

10 Claims, 8 Drawing Sheets

SPARK PLUG FOR USE IN INTERNAL COMBUSTION ENGINE

BACKGROUND OF THE INVENTION

The present invention relates to a spark plug for use in internal combustion engines and, more particularly, to a spark plug having an electrode which is provided with a spark discharge portion made of a base metal resistant to wear caused by sparking.

In a conventional spark plug for use in internal combustion engines, as disclosed in Japanese Patent Unexamined Publication No. 57-180886, a spark discharge layer (referred to as "discharge layer" hereinafter) which is formed from a noble metal on the central and/or grounding electrode by, for example, resistance welding.

In operation, sparking discharge takes place on the discharge layer. The discharge layer made of a noble metal, however, exhibits a reduced amount of wear so as to enable the spark plug to be used for a long time.

The use of a noble metal as the material of the discharge layer, however, incurs a rise in the cost.

On the other hand, Japanese Patent Unexamined Publication No. 61-26748 discloses a spark plug having a discharge layer which is formed of an inexpensive tungsten alloy.

More specifically, in this spark plug, the discharge layer is formed of an alloy having a composition containing 15 to 40 wt % of chromium (Cr) and the balance substantially tungsten (W), or an alloy composed of 1 to 10 wt % of an element selected from a group which consists of silicon (S), aluminum (Al), nickel (Ni) and iron (Fe), and the balance substantially W.

The discharge layer formed on an electrode of a spark plug from the above-mentioned tungsten alloy, however, encounters a problem in that the tungsten alloy is oxidized at high temperature at an impractically high speed, with the result that the discharge layer is worn rapidly. Thus, the discharge layer formed from the tungsten alloy impairs the service life of the spark plug, although it contributes to a reduction in the cost.

SUMMARY OF THE INVENTION

Accordingly, an object of the present invention is to provide a spark plug having a discharge portion made of a base metal having such a high Cr content as could never be imagined conventionally, the discharge portion exhibiting superior resistance to wear caused by sparking discharge thereby to overcome the above-described problems of the prior art.

To this end, according to one aspect of the present invention, there is provided a spark plug for use in internal combustion engines having a pair of electrodes between which electric spark discharge is effected, the spark plug comprising: a spark discharge portion provided on at least one of the electrodes and made of a base metal containing not less than 90 wt % of chromium (Cr).

According to another aspect of the invention, there is provided a spark plug for use in internal combustion engines having a pair of electrodes between which electric spark discharge is effected, the spark plug comprising at least one of the electrodes both a spark discharge portion made of a base metal containing not less than 90 wt % of chromium (Cr) and a stress-relieving portion which is made of a base metal having a thermal expansion coefficient ranging between those of the material of the associated electrodes and of the base metal used as the material of the spark discharge portion.

The base metal used as the material of the spark discharge portion of the present invention should contain not less than 90 wt % of Cr, because any Cr content below 90 wt % undesirably increases the consumption of the spark discharge portion, resulting in a shorter service life of the spark plug.

The stress-relieving portion provided in the spark plug of the invention is intended for preventing occurrence of cracking in the spark discharge portion attributable to a difference in the thermal expansion coefficient between the material of the spark plug and the base metal used as the material of the spark discharge portion. In order to obtain a satisfactory stress-relieving effect, it is essential that the thermal expansion coefficient of the base metal used as the material of the stress-relieving portion falls within the above-specified range.

The above and other objects, features and advantages of the present invention will become clear from the following description of the preferred embodiments when the same is read in conjunction with the accompanying drawings.

DESCRIPTION OF THE PREFERRED EMBODIMENTS

Preferred embodiments of the invention will be described hereinunder with reference to the accompanying drawings.

Figure 1:
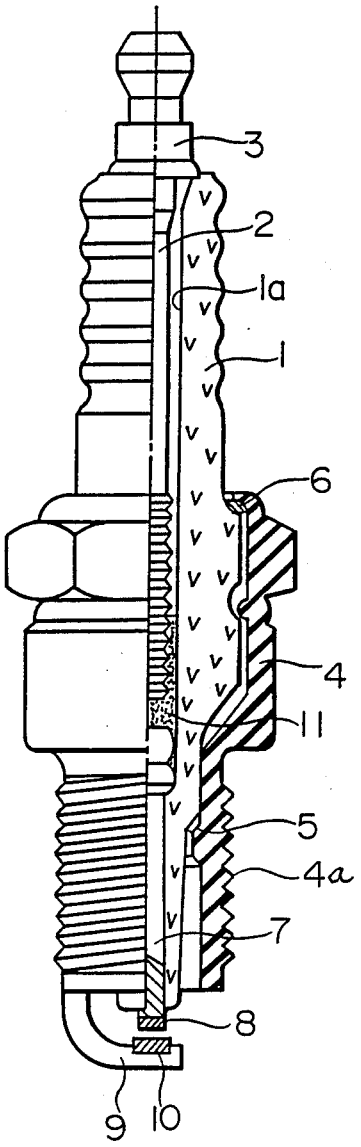
FIG. 1 is a partly-sectioned elevational view of an embodiment of the spark plug in accordance with the present invention.
Figure 2:
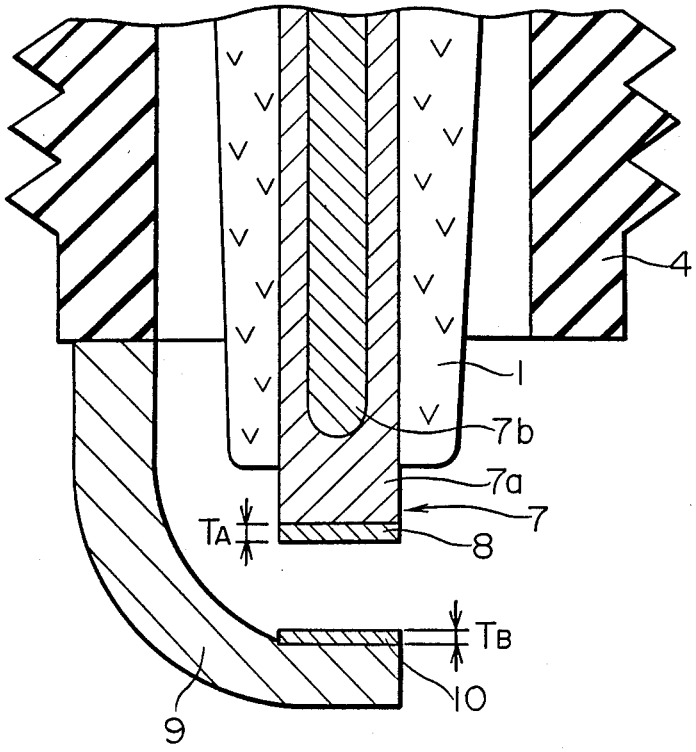
FIG. 2 is an enlarged view of an essential portion of the spark plug shown in FIG. 2.

Referring to FIGS. 1 and 2, a spark plug embodying the present invention has an insulator 1 made of alumina-type ceramics and having a central axial bore la which receives at its upper portion an intermediate shaft 2 made of a carbon steel. A terminal 3, which is made of a bronze, for example, is fixed by screwing into the head of the intermediate shaft 2. The spark plug also has a cylindrical housing 4 which is made of a heat-resistant metal. The insulator 1 is fixed inside the housing 4 through the intermediary of a ring-shaped hermetic packing 5 by means of a caulking ring 6. The housing 4 is provided with a threaded portion 4*a* which is adapted to be screwed into a threaded bore formed in the wall of an engine block (not shown) thereby to fix the spark plug on the engine block.

The spark plug further has a central electrode 7 which is composed of a core portion 7*b* made of copper and a sheath portion 7*a* which is made of a heat- and corrosion-resistant conductive metallic material, e.g., an inconel material of Ni-Cr system. The central electrode 7 is covered at its end surface with a spark discharge portion 8 having a disk-like form and fixed thereto by, for example, resistance welding.

The spark plug also has a grounding electrode 9 which is made of a heat- and corrosion-resistant conductive metallic material, e.g., an inconel material of Ni-Cr system. The grounding electrode 9 is fixed to an end surface of the housing 4. The portion of the grounding electrode 9 facing the discharge portion 8 on the central electrode 7 is covered by a cooperative discharge portion 10 which is fixed thereto by, for example, resistance welding. The discharge portion 10 has a disk-like or an oval form.

A reference numeral 11 designates a conductive glass sealing layer charged in the bore 1*a* of the insulator 1 and made of a copper alloy and a glass having a low melting temperature. This sealing layer electrically connects the intermediate shaft 2 and the central electrode 7 and fix them against any movement within the axial bore 1*a* in the insulator 1.

The critical feature of the spark plug in accordance with the present invention pertains to the composition of the material of the discharge portions 8, 10. Namely, the invention features that the discharge portions 8, 10 are made of a base metal material containing at least 90 wt % of Cr and having a thickness ($T_A$, $T_B$) which is not smaller than 0.3 mm.

Figure 3:
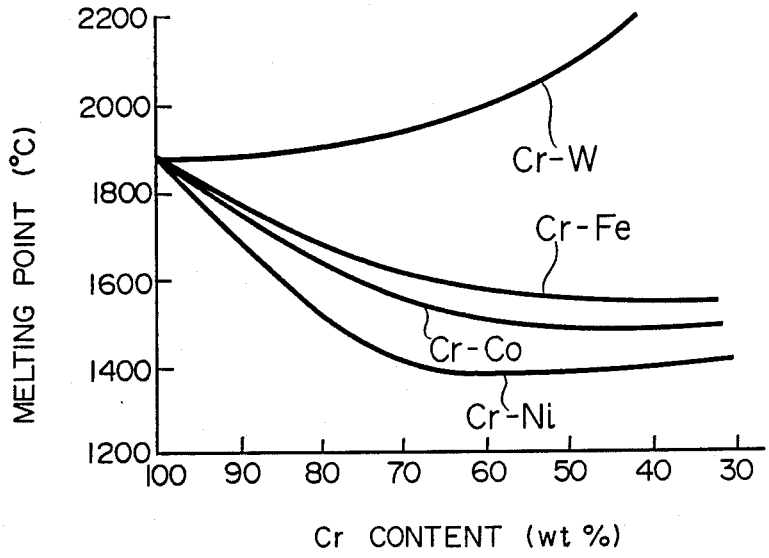
FIGS. 3 to 5 and FIG. 7 are diagrams showing characteristics of spark plugs in relation to Cr content of the base metal used as the material of the discharge portion.
Figure 4:
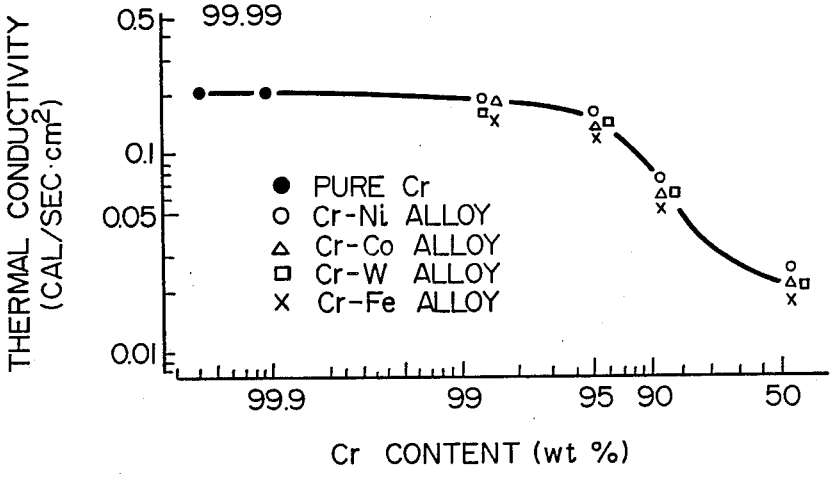
Figure 5:
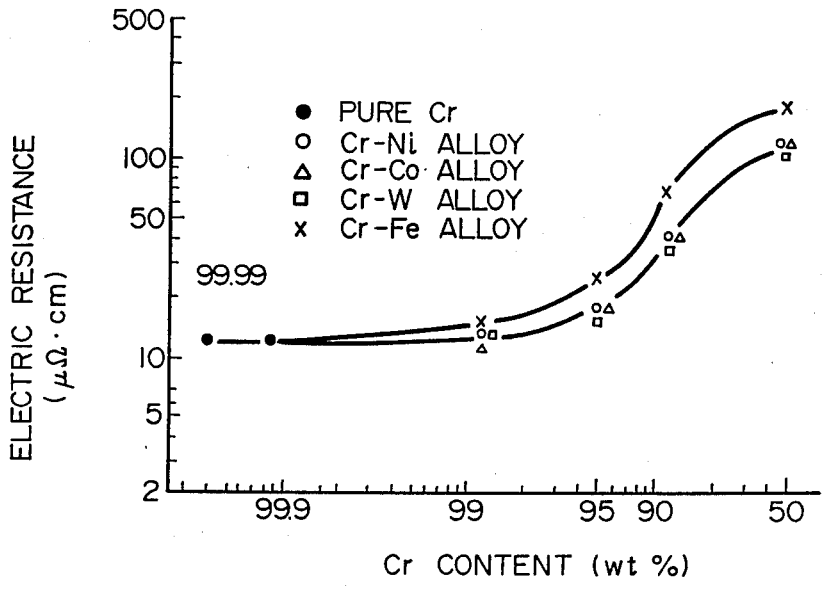

A study was made by the inventors to investigate how the characteristics which closely relate to the spark-wear resistance, e.g., melting point, thermal conductivity and electrical resistance, are varied in relation to a change in the Cr content of the material of the discharge portion. The results are shown in FIGS. 3 to 5. As to the case of pure Cr, data obtained both with 99.9% Cr and 99.99% Cr are shown.

Figure 6:
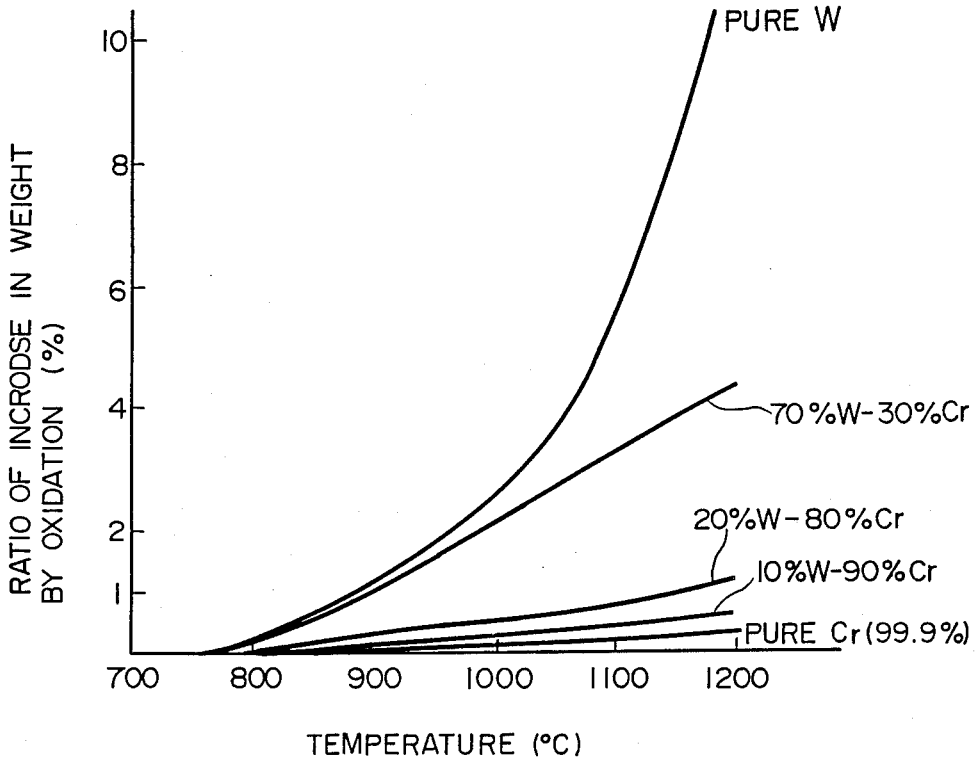
FIGS. 6 and 8 are illustrations of advantages of the spark plug of the present invention.

FIG. 6 shows the result of a test conducted to investigate the oxidation resistance of Cr-W alloy which is one of the materials usable as the material of the discharge portion in the spark plug of the invention and which exhibits inferior oxidation resistance amongst the usable materials. More specifically, FIG. 6 shows oxidation weight increment of a Cr-W test piece when the latter was heated in atmospheric air at different temperatures one hour at each temperature.

From FIGS. 3 to 5 it will be understood that the melting point, thermal conductivity and electric resistance are rapidly impaired when the content of each of Fe, Ni and Co exceeds 10 wt %, i.e., when the Cr content comes down below 90 wt %.

It will also be understood from FIGS. 3 to 6 that the thermal conductivity and the electric resistance are unfavorably changed when the W content is increased and that the anti-oxidation characteristic is drastically reduced when the W content exceeds 10 wt %, i.e., when the Cr content comes down below 90 wt %.

Figure 7:
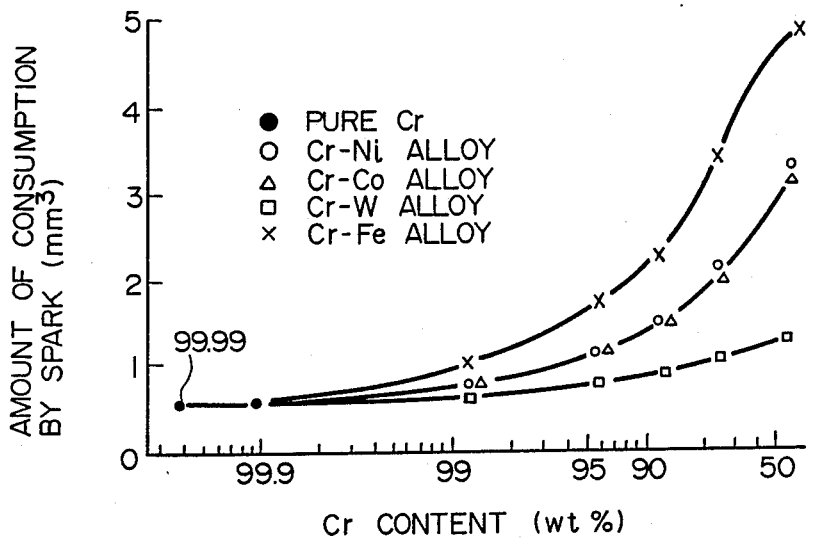

FIG. 7 shows the result of experiment conducted to examine the spark-wear resistance of the material. The experiment was conducted by subjecting a spark plug to 100-hour sparking at a frequency of 1200 spark cycles/minute by means of an ignition power supply having sparking energy of 50 mJ within a pressure vessel which maintained atmospheric air of 5 kg·cm$^2$ and 200° C. The spark plug used in the experiment had discharge portions 8, 10 bonded to the central and grounding electrodes in the manner shown in FIG. 2. The basic construction of the spark plug was the same as a spark plug Model W16EXR-U, produced by Nippon Denso Kabushiki Kaisha.

As will be understood from the result shown in FIG. 7, the greater the Cr content of the material of the discharge portion, the smaller the material consumption by sparking. Excellent spark-wear resistance was obtained when the Cr content became not less than 90 wt %. The same result was confirmed through a test of spark plugs on an actual engine.

Figure 8:
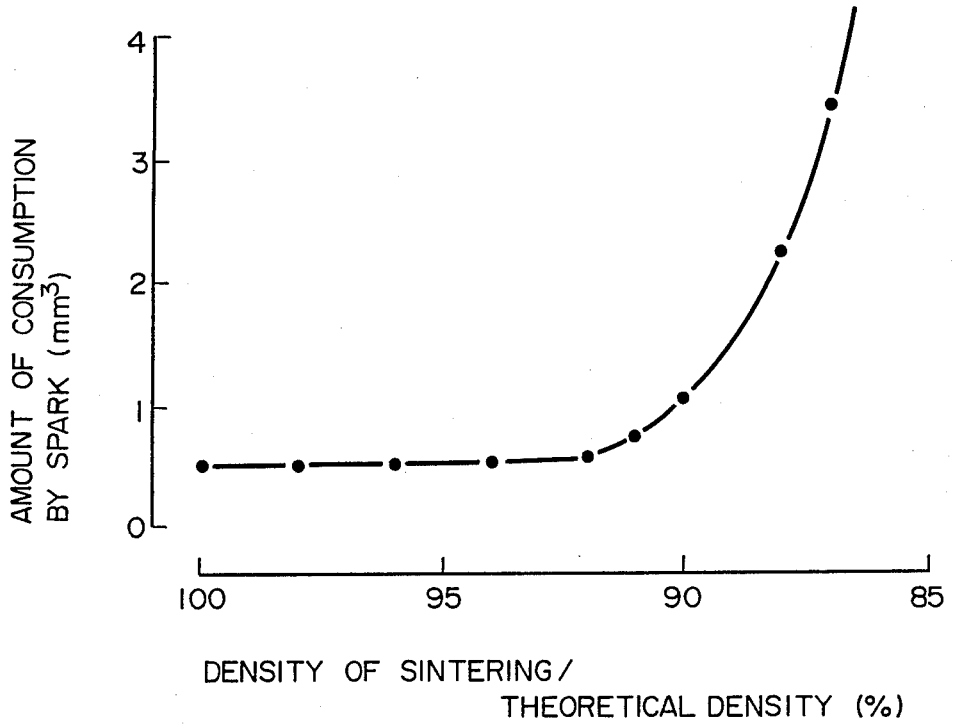

Chromium alloys and pure chromium, which are used as the material of the discharge portion in the spark plug of the invention, exhibits inferior cold forgibility. The invention, therefore may be carried out by using an ordinary solvent material. Alternatively, the metallic material of the discharge portion may be powdered and then compacted, i.e., sintered, so as to form the discharge portion. When the sintering method is adopted, however, there is a risk for the material to degrade its resistance to spark wear, depending on the ratio between the sintering density and the theoretical density. The inventors therefore conducted a test to investigate the relation between the ratio sintering density/theoretical density and the spark wear of the material, the result of which is shown in FIG. 8. The experiment was conducted in the same way as that used in the experiment of FIG. 7. The spark plug used in this experiment had discharge portions 8, 10 of about 1 mm thick bonded to the central and grounding electrodes as shown in FIG. 2. The experiment was conducted while varying the value of the ratio sintering density/theoretical density.

The basic construction of the plug was the same as that of the plug Model W16WXR-L manufactured by Nippon Denso Kabushiki Kaisha. As will be understood from the result shown in FIG. 8, the spark wear amount becomes smaller as the value of the ratio sintering density/theoretical density is increased. This effect, however, is substantially saturated when the ratio is not less than 90%. Namely, no remarkable reduction in the spark wear of the material is observed even when the ratio is made to approach 100%, i.e., the spark wear obtained when the ratio is 100% was materially the same as that obtained when the ratio is 90%.

In the described embodiment, the spark discharge portions are made of a material which is different from the materials of the respective electrodes 7, 9. In consequence, a thermal stress is generated in the boundary between the discharge portion and the associated electrode, due to the difference in the thermal expansion coefficient therebetween.

The inventors therefore conducted an experiment for the purpose of examining the influence of such a thermal stress. The experiment was conducted by using a spark plug Model W16EX-U manufactured by Nippon Denso Kabushiki Kaisha, with discharge portions made of pure Cr (purity 99.9%, the balance being incidental inclusions) of various thicknesses $T_A$, $T_B$ and having a thermal expansion coefficient of $6.5\times10^{-6}$/°C., bonded to the respective electrodes by resistance welding.

The central and grounding electrodes were made of an alloy composed of 77.5 wt % of Ni, 15.15 wt % of Cr and 7 wt % of Fe. The thermal expansion coefficient of this electrode material was $13.5\times10^{-6}$/°C. The experiment was conducted by using a 4-stroke cycle engine having a displacement of 2600 cc. With the test plug installed, the engine was operated for 100 hours while cyclically repeating 1-minute operation at 5000 r.p.m. which is the operating condition giving the severest thermal condition in the use of commercial engines, followed by 1-minute idling.

Figure 9:
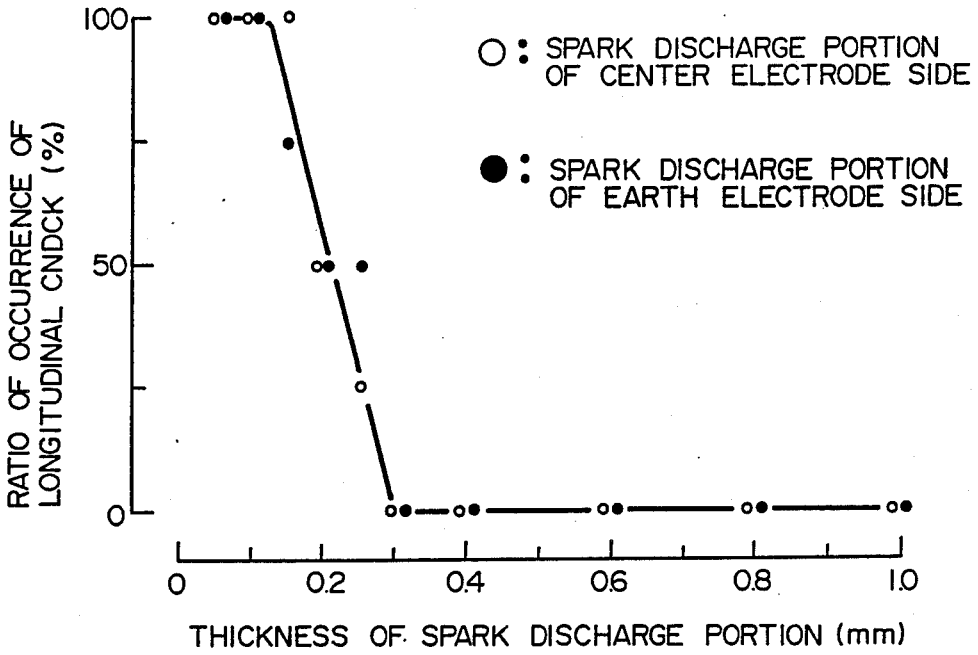
FIG. 9 is a graph showing a relationship between the occurrence of axial cracks and the thickness of a spark discharge portion.
Figure 10:
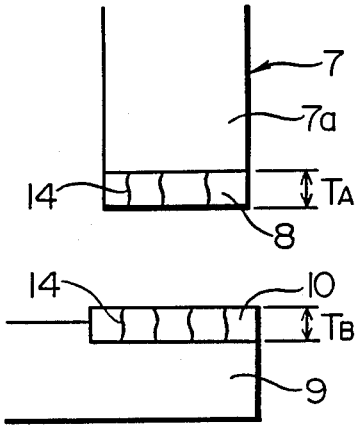
FIGS. 10 and 11 are enlarged sectional views of the central electrode and the grounding electrode illustrating the undesirable cases.

The result of this experiment is shown in FIG. 9. More specifically, in FIG. 9, the axis of abscissa shows the thicknesses $T_A$, $T_B$ of the discharge portions of the central and grounding electrodes, while the axis of ordinate represents the rate of generation of cracks as shown in FIG. 10, the cracking rate was measured by employing four plugs for each of the thickness of each discharge portion. It will be seen that, in each case of the central and grounding electrodes, cracks 14 are tend to occur from the surface of the discharge portion to the boundary between the discharge portion and the electrode, as the thickness of the discharge portion is reduced. The crack 14, however, does not occur when the thicknesses $T_A$, $T_B$ of the discharge portion are not smaller than 0.3 mm.

Figure 11:
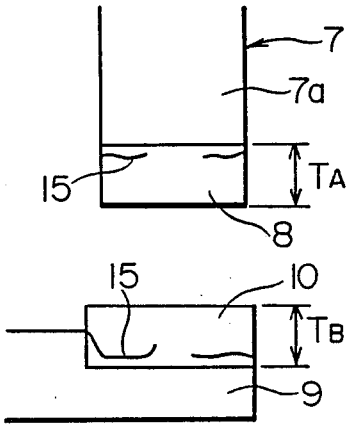

The thicknesses $T_A$, $T_B$ of the discharge portions not smaller than 0.3 mm, adopted for the purpose of preventing vertical cracks 14 as shown in FIG. 10, tend to be accompanied by occurrence of a lateral crack 15 shown in FIG. 11 substantially parallel to the welding surface, in the region of the discharge portion near the boundary between the discharge portion and the electrode. This lateral crack 15 was not found during the test conducted under the conditions simulating the conditions of uses of commercial products. The inventors however, recognized that, in view of the recent demand for high power and high performance of the engines, such a lateral crack may grow large to such an extent as to cause the discharge portion to peel off during long use of the spark plugs in such engines.

Figure 12:
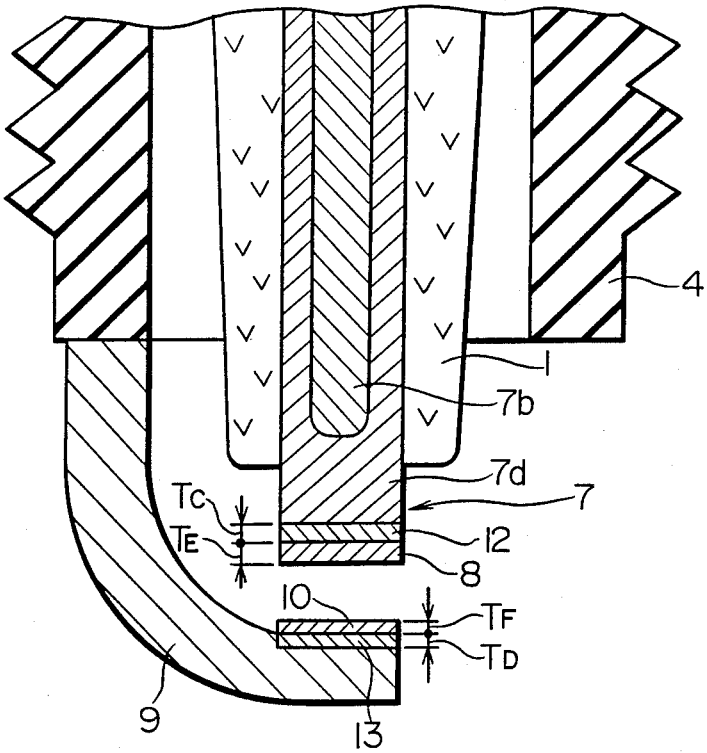
FIG. 12 is an enlarged sectional view of another embodiment of the present invention.

FIG. 12 shows another embodiment of the spark plug in accordance with the present invention, provided with a thermal stress relieving portion provided between the discharge portion and the associated electrode for the purpose of preventing occurrence of the lateral crack mentioned above. In this Figure, the same reference numerals are used to denote the same parts or members appearing in FIG. 2. The stress relieving layers for the respective discharge portions are denoted by numerals 12 and 13. As stated before, the electrode 7, particularly the sheath 7*a*, and the electrode 9 to which the discharge portions are to be bonded are made of inconel 600 or a similar material, which exhibits a thermal expansion coefficient of $13.5\times10^{-6}$/°C. to $14.0\times10^{-6}$/°C. On the other hand, the base metal material rich in Cr, i.e., having a Cr content not smaller than 90 wt %, used as the material of the discharge portion has a thermal expansion coefficient of $6.5\times10^{-6}$/°C. to $7.0\times10^{-6}$/°C. Thus, the difference in the thermal expansion coefficient between the electrodes 7,9 and the discharge portions 8, 10 is as large as $7.0\times10^{-6}$/°C., and a thermal stress attributable to this difference causes the cracks in the discharge portions 8, 10.

Figure 13:
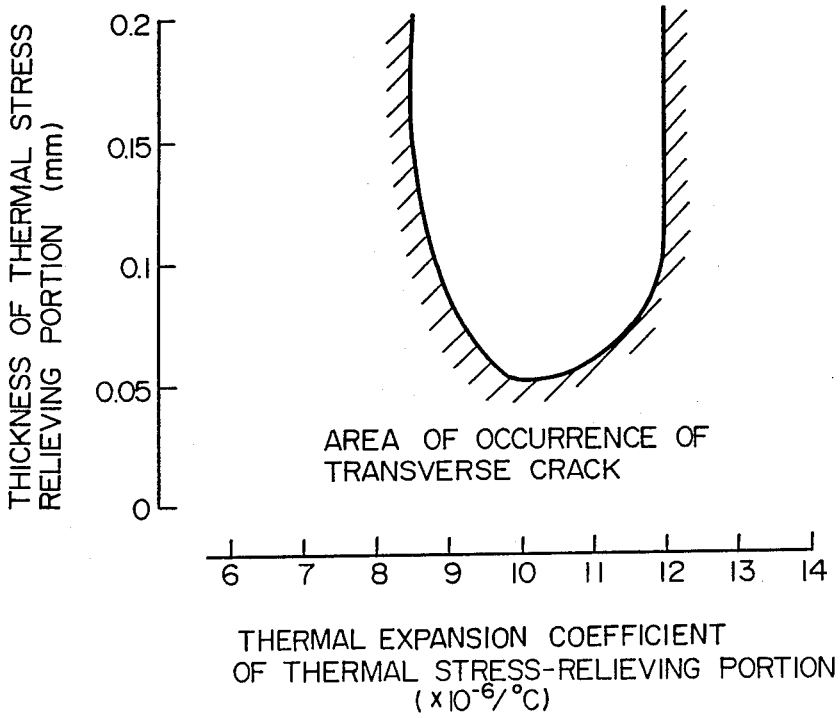
FIG. 13 is a characteristic diagram illustrating advantages of the present invention.

FIG. 13 shows the result: of an experiment which was conducted to investigate the relation between the values of the thermal expansion coefficients of the stress relieving portions 12, 13, thicknesses $T_C$, $T_D$ of the stress relieving portions and the tendency of lateral cracking in the discharge portions 8, 10.

The plug used in this experiment was basically the same as a spark plug Model W16WXR-U. To the central and grounding electrodes of this plug there were bonded by resistance welding stress-relieving layer of various thicknesses $T_C$, $T_D$ made of various Ni-Cr alloys and discharge portions having thicknesses $T_E$, $T_F$ and made of pure Cr (purity 99.9%, the balance incidental inclusions). The thermal expansion coefficients of the Ni-Cr alloy used as the materials of the stress relieving portions were varied within the range between $13.5\times10^{-6}$/°C. and $6.5\times10^{-6}$/°C., while the discharge portion had a thermal expansion coefficient of $6.5\times10^{-6}$/°C. Both the central and grounding electrodes were made of an alloy composed of 77.5 wt % of Ni, 15.5 wt % of Cr and 7 wt % of Fe and having a thermal expansion coefficient of $13.5\times10^{-6}$/°C. The plugs were tested on an actual 4-stroke-cycle engine having a displacement of 2600 cc which was operated for 100 hours while repeating operation cycles each included 1 minute operation at 5000 r.p.m. followed by 1-minute idling. The test was conducted with different plugs having different thicknesses $T_C$, $T_D$ and thermal expansion coefficients of the stress relieving portions.

As will be understood from FIG. 13, cracking in the discharge portions 8, 10 can be avoided when the stress relieving portions 12, 13 are made of base metal having thermal expansion coefficients ranging between $8.5\times10^{-6}$/°C. and $12.0\times10^{-6}$/°C. In order to obtain a thermal expansion coefficient which falls within this range, the Ni-Cr alloy used as the material of the stress-relieving portion should have Cr content of between 50 and 80 wt %, with the balance 50 to 15 wt % being constituted by Ni. The thickness of the stress-relieving portions necessary for preventing lateral cracking is 0.05 mm or greater when the thermal expansion coefficient of the stress-relieving portion is $10.0\times10^{-6}$/°C. The thicknesses $T_D$, $T_C$ necessary for preventing the lateral cracking tends to increase when the thermal expansion coefficient is decreased or increased beyond $10.0\times10^{-6}$/°C. For instance, the thicknesses of the stress-relieving portions should be not smaller than 0.15 mm when the thermal expansion coefficient is $8.5\times10^{-6}$/°C., and should be not smaller than 0.1 mm when the thermal expansion coefficient is $12.0\times10^{-6}$/°C. the stress-relieving portions in the described manner eliminates inconveniences shown in FIG. 9 even when the chromium layer constituting the discharge portions has thicknesses $T_E$, $T_F$ not greater than 0.3 mm.

It is, however, preferred that the chromium layer constituting each discharge portion has a thickness not smaller than 0.1 mm, form the view point of manufacturing process and the service life of the product spark plug.

It is thus possible to prevent cracking of the discharge portions 8, 10, by providing, between the respective electrodes and the discharge portions, the stress-relieving portions having appropriate thicknesses and suitable values of thermal expansion coefficient which ranges between those of the material of the electrodes 7, 9 and the material of the discharge portions 8, 10.

Figure 14:
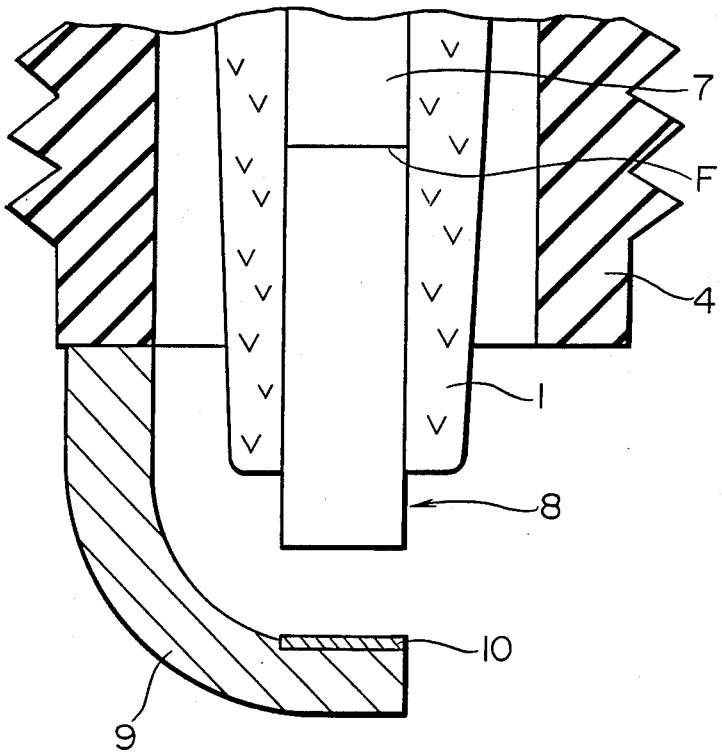
FIG. 14 is a sectional view of still another embodiment of the present invention.

FIG. 14 shows still another embodiment of the spark plug in accordance with the present invention. This embodiment features that the discharge portion 8 on the central electrode 7 is disposed so as to extend into the bore 1*a* of the insulator 1 and bonded central electrode 7 at a position F, unlike the discharge charge portions 8 of the preceding embodiments which are formed as layers. In this embodiment also, the discharge portions are made of a base metal having a Cr content not smaller than 90 wt %. The base metal having a Cr content not smaller than 90 wt % exhibits a thermal expansion coefficient which approximates that of the alumina-sintering member constituting the insulator 1, so that it is possible to eliminate the gap between the discharge portion 8 and the wall of the bore 1*a* in the insulator 1, thus complying with the demand for a reduction in the size of spark plugs.

Although the invention has been described through its preferred forms, it is to be noted that the described embodiments are only illustrative and various modifications may be imparted thereto, as summarized hereinbelow.

(1) The discharge portion may be provided on both or only one of the central electrode and the grounding electrode. The same is applied also to the combination of the discharge portion and the stress-relieving portion.

(2) Although the base metal used as the material of the discharge portion has been stated as being allowed to contain up to 10 wt % of one of Fe, Ni, Co and W. The base material, however, can contain up to 10 wt % in total of two or more of these metals, or may contain other metal or metals than those mentioned above, as well as incidental inclusions, provided that the Cr content is not smaller than 90 wt %.

(3) The use of alloy containing 50 to 85 wt % of Cr and 50 to 15 wt % of Ni as the material of the stress-relieving portion are is only illustrative. Namely, the stress-relieving portion may be composed of an Fe-Ni alloy or an Fe-Ni-Cr alloy which contains 5 to 50 wt % of one or both of Ni and Cr and the balance (95 to 50 wt %) Fe, such as an alloy composed of 52 wt % of Fe, 42 wt % of Ni and 6 wt % of cr (thermal expansion coefficient 8.5 to $9.2\times10^{-6}$/°C.) or an alloy composed of 47 wt % of Fe, 47 wt % of Ni and 6 wt % of Cr (thermal expansion coefficient 10.0 to $11.0\times1-^{-6}$/°C.). The alloy used as the material of the stress-relieving portion may contain not greater than 1 wt % of titanium and/or greater than 5 wt % of aluminum, for the purpose of improving the oxidation resistance.

(4) The metal used as the material of the central electrode 7 and the grounding electrode 9 may be an alloy composed of 93 wt % of Ni, 2 wt % of Cr, 3 wt % of Mn and 2 wt % of Si.

(5) The stress-relieving portion may be bonded to the discharge portion by diffusion welding, though in the described embodiment resistance welding is adopted as the bonding method. It is also possible to subject the electrode and the stress-relieving portion welded thereto to a heat treatment so that an alloy is formed therebetween thus attaining a further stress-relieving effect. Such an alloy layer preferably has a thickness which is not smaller than 10 μm. The same applies also to the bonding between the stress-relieving portion and the discharge portion.

As has been described, according to the invention, either one or both of the central and discharge electrodes of a spark plug are provided with discharge portions made of a base metal containing at least 90 wt % of Cr, so that the wear or consumption of the spark discharging portions can be remarkably decreased, thus ensuring a long service life of the spark plug while reducing the cost.

In addition, in a specific form of the invention, a stress-relieving portion is provided between the discharge portion and the associated electrode, the stress-relieving portion being made of a base metal having a thermal expansion coefficient intermediate between those of the electrode material and the material of the discharge portion. The stress-relieving portion effectively relieves thermal stress which is developed between the discharge portion and the material of the electrode, whereby undesirably cracking in the discharge portion can be avoided.

What is claimed is:

1. A spark plug for use in internal combustion engines having a pair of electrodes between which electric spark discharge is effected, said spark plug comprising:

a spark discharge portion provided on at least one of said electrodes and made of a base metal containing not less than 90 wt % of chromium (Cr), wherein the thickness of said discharge portion is not smaller than 0.3 mm.

2. A spark plug for use in internal combustion engines according to claim 1, wherein said base metal used as the material of said spark discharge portion is pure Cr containing incidental impurities.

3. A spark plug for use in internal combustion engines according to claim 1, wherein said spark discharge portion is provided on each of said electrodes.

4. A spark plug for use in internal combustion engines having a pair of electrodes between which electric spark discharge is effected, said spark plug comprising:

a spark discharge portion provided on at least one of said electrodes and made of a base metal containing not less than 90 wt % of chromium (Cr), wherein said base metal used as the material of said spark discharge portion is an alloy which contains not less than 90 wt % of Cr and not more than 10 wt % of one or more of iron (Fe), nickel (Ni), cobalt (Co) and tungsten (W), the sum of the Cr content and the content of said one or more of Fe, Ni, Co and W being 100 wt %.

5. A spark plug for use in internal combustion engines having a pair of electrodes between which electric spark discharge is effected, at least one of said electrodes having both a spark discharge potion made of a base metal containing not less than 90 wt % of chromium (Cr) and a stress-relieving portion made of a base metal having a thermal expansion coefficient ranging between thermal expansion coefficients of both the material of the associated electrodes and of said base metal used as the material of said spark discharge portion, wherein said base metal used as the material of said stress-relieving portion has a thermal expansion coefficient ranging between $8.5\times10^{-6}$/°C.

6. A spark plug for use in internal combustion engines according to claim 5, wherein said base metal used as the material of said spark discharge portion is pure Cr containing incidental impurities.

7. A spark plug for use in internal combustion engines according to claim 5, wherein said spark discharge portion and said stress relieving portion are provided on each of said electrodes.

8. A spark plug for use in internal combustion engines having a pair of electrodes between which electric spark discharge is effected, at least one of said electrodes having both a spark discharge portion made of a base metal containing not less than 90 wt % of chromium (Cr) and a stress-relieving portion made of a base metal having a thermal expansion coefficient ranging between thermal expansion coefficients of both the material of the associated electrodes and of said base metal used as the material of said spark discharge portion, wherein said base metal used as the material of said stress-relieving portion has a thermal expansion coefficient ranging between $8.5\times10^{-6}$/°C. and $12.0\times10^{-6}$/°C., the thickness of said stress-relieving portion being at least 0.05 mm when the thermal expansion coefficient is $10\times10^{-6}$/°C., the thickness increasing beyond 0.05 mm when the thermal expansion coefficient is increased or decreased beyond $10\times10^{-6}$/°C. within the range of $8.5\times10^{-6}$/°C. to $12.0\times10^{-6}$/°C., said thickness being at least 0.15 mm when said thermal expansion coefficient is $8.5\times10^{-6}$/°C. and at least 0.1 mm when said thermal expansion coefficient is $12.0\times10^{-6}$/°C.

9. A spark plug for use in internal combustion engines having a pair of electrodes between which electric spark discharge is effected, at least one of said electrodes having both a spark discharge portion made of a base metal containing not less than 90 wt % of chromium (Cr) and a stress-relieving portion made of a base metal having a thermal expansion coefficient ranging between thermal expansion coefficients of both the material of the associated electrodes and of said base metal used as the material of said spark discharge portion, wherein said base metal used as the material of said stress-relieving portion is an alloy selected from a group of the following alloys (a) to (c):

(a) an alloy consisting of 50 to 15 wt % of Ni and 50 to 85 wt % of Cr;

(b) an alloy consisting of 5 to 50 wt % of Ni and/or Cr and the balance 95 to 50 wt % of Fe; and (c) an alloy consisting of 5 to 50 wt % of Ni and/or Cr, not more than 6 wt % of at least one of titanium and aluminum, and the balance 95 to 44 wt % of Fe.

10. A spark plug for use in internal combustion engines having a pair of electrodes between which electric spark discharge is effected, at least one of said electrodes having both a spark discharge portion made of a base metal containing not less than 90 wt % of chromium (Cr) and a stress-relieving portion made of a base metal having a thermal expansion coefficient ranging between thermal expansion coefficients of both the material of the associated electrodes and of said base metal used as the material of said spark discharge portion, wherein said base metal used as the material of said spark discharge portion is an alloy which contains not smaller than 90 wt % of Cr and not more than 10 wt % of one or more selected from the group consisting of iron (Fe), nickel (Ni), cobalt (Co) and tungsten (W), the sum of the Cr content and the content of said one or more of Fe, Ni, Co and W being 100 wt % .

* * * * *